US006402082B1

(12) United States Patent
Madrzak et al.

(10) Patent No.: US 6,402,082 B1
(45) Date of Patent: Jun. 11, 2002

(54) WINDING MACHINE AND PROCESS FOR WINDING A MATERIAL WEB

(75) Inventors: Zygmunt Madrzak, Heidenheim; Roland Möller, Herbrechtingen; Georg Ihle, Steinheim, all of (DE)

(73) Assignee: Voith Sulzer Papiertecknik Patent GmbH, Heidenheim (DE)

( * ) Notice: Subject to any disclaimer, the term of this patent is extended or adjusted under 35 U.S.C. 154(b) by 0 days.

(21) Appl. No.: 09/437,782

(22) Filed: Nov. 10, 1999

(30) Foreign Application Priority Data

Nov. 12, 1998 (DE) ..... 198 52 257

(51) Int. Cl.[7] ..... B65H 18/14
(52) U.S. Cl. ..... 242/541.4; 242/541.5
(58) Field of Search ..... 242/541.1, 541.4, 242/541.5, 541.6, 541.7, 542.3, 534

(56) References Cited

U.S. PATENT DOCUMENTS

| | | | |
|---|---|---|---|
| 3,834,642 | A | 9/1974 | Kampf |
| 5,308,008 | A | 5/1994 | Rüegg |
| 5,370,327 | A | 12/1994 | Adamski |
| 5,611,500 | A | 3/1997 | Smith |

FOREIGN PATENT DOCUMENTS

| | | |
|---|---|---|
| DE | 2214350 | 10/1973 |
| DE | 3627463 | 2/1988 |
| EP | 0561128 | 9/1993 |
| WO | 93/24401 | 12/1993 |
| WO | 98/52858 | 11/1998 |

OTHER PUBLICATIONS

Patent Abstract of Japan Publication No. 62196253, published Aug. 29, 1987.

*Primary Examiner*—John Q. Nguyen
(74) *Attorney, Agent, or Firm*—Greenblum & Bernstein, P.L.C.

(57) ABSTRACT

Apparatus and process for winding a material web into a wound roll on a winding core. The apparatus includes a press roll, movable press roll bearings coupled to the press roll, and a pressing device positioned to press the press roll against the wound roll. In this manner, the press roll and the wound roll form a winding nip, and the material web is guided the press roll and through the winding nip. The pressing device is adapted to set a line load in the winding nip, and movable winding core bearings are couplable to the winding core of the wound roll and are adapted to move the winding core to compensate for an increasing wound roll diameter. The winding nip one of remains in an at least approximately same position and is displaced by a small amount during winding. A driving device is positioned to move each of the movable winding core bearings, and a control device is arranged to control the driving device as a function of movement of the press roll from a desired position. A position measurement device, coupled to at least one of the movable press roll bearings, is adapted to produce an instantaneous position value of the press roll in accordance with a current position of the press roll, a regulator is adapted to compare the instantaneous position value with a desired position value of the press roll and to transmit an actuating variable that corresponds to a deviation of the instantaneous value from the desired value, and a wire is adapted to transmit the actuating variable from the regulator to the control device.

23 Claims, 3 Drawing Sheets

35
33
55a
55b
57a
57b
61
12
18
53
49
M
52
22
50
36
14
46
20'
44
45a
42
45b

WINDING MACHINE AND PROCESS FOR WINDING A MATERIAL WEB

CROSS-REFERENCE TO RELATED APPLICATIONS

The present application claims priority under 35 U.S.C. §119 of German Patent Application No. 198 52 257.6, filed on Nov. 12, 1998, the disclosure of which is expressly incorporated by reference herein in its entirety.

BACKGROUND OF THE INVENTION

1. Field of the Invention

The present invention relates to a winding machine and process for winding a material web onto a winding core, e.g., a reel spool, so that a wound roll is formed on the winding core. The winding machine includes a press roll (carrier drum) that rests in two moveable bearings so as to be pressed against the wound roll via a pressing device, thereby forming a winding nip. The material web can be guided to partially surround the press roll and to run through the winding nip, which can be set with a desired line load by the pressing device. The winding core, as well as the wound roll, can be arranged within moveable bearings that displace the winding core as the diameter of the wound roll increases so as either to maintain the winding nip at least approximately the same position or to displace the winding nip by only a relatively small amount, e.g., about 10 to 200 mm, during winding. Each of the bearings of the winding core can be displaced by an associated driving device, and a control device is adapted to control the driving device as a function of displacement of the pressing roll from a desired or preferred position.

2. Discussion of Background Information

Such a winding machine is known, e.g., from German Publication No. DE 2 214 350 and its U.S. family member U.S. Pat. No. 3,834,642. Winding machines of the type generally disclosed in these documents are, for example, located at the end of a machine for producing, refining, or otherwise processing a paper web. In the known winding machine, the press roll rests in bearings that are attached to a pivoted lever. The bearings of the winding core can be moved horizontally by a threaded spindle which is provided with a drive that is controlled as a function of displacement of the pivoted levers carrying the press roll. Such a control process is initiated by the opening or closing of a contact.

As with the instant invention, the winding core and wound roll are displaced in accordance with the increase in diameter of the wound roll so that the position of the winding nip remains at least approximately the same during the winding process. However, the known arrangements do not meet the demands placed upon winding machines that serve as a part of a modem high-performance machine for producing or processing a material web. Such high-performance machines normally have a working width of up to approximately 10 m, where work speeds are achieved of around 1500 to 2500 m/min.

The demands placed on such winding machines include, e.g., that:

A. control of winding core displacement (in accordance with the increase in diameter of the wound roll) must occur in as jerk-free a manner as possible and with extreme precision.

B. movements of a press roll bed (when setting the desired line load in the winding nip) must be as small as possible and occur as slowly as possible.

C. the above requirements A and B must contribute to lessening the danger of vibrations and to minimizing the danger of the web ripping because a rip can cause enormous amounts of waste paper to result within seconds.

SUMMARY OF THE INVENTION

The present invention provides a winding machine similar in general to that discussed above that includes a position measurement device coupled to at least one of the two bearings of the press roll to produce an instantaneous position value that is dependent upon an instantaneous (current) position of the pressing roll, a regulator that compares the instantaneous position value with a desired position value and that provides an actuating variable that corresponds to the deviation of the instantaneous value from the desired value, and a wire transmitting the actuating variable from the regulator to the control device of the driving devices so that the above-mentioned requirements are fulfilled to the greatest extent possible.

Therefore, according to the invention, the position regulator is provided for the press roll to ensure that the moveable press roll can supply the material web to the wound roll while maintaining a line load which can be set as desired in the winding nip and to ensure that, in spite of the rapid increase in diameter of the wound roll, the press roll departs from a desired center position only briefly and by very short distances. During a winding process, the displacement movements of the press roll are relatively slow and never jerky, thus, the danger of vibrations and paper rips is eliminated. Moreover, it is possible to intentionally displace the position of the press roll by a relatively short distance, e.g., between approximately 10 and 200 mm, with the aid of the regulator. However, when doing so, the regulator again provides a calm and slow displacement of the press roll.

According to the invention, it has been found that an additional problem that arises in winding especially wide material webs, i.e., the material web can temporarily have very small differences in thickness across its width. Thus, the web can, e.g., be thicker by a very small amount in the region of one edge than at the other edge. This leads to the danger that a wound roll will result that is not exactly cylindrical, but rather is slightly conical. This problem may appear even more markedly in the case in which the wound rolls are produced with a particularly large diameter, e.g., between approximately 3 to 4 m. It has been recognized that such difficult conditions can be better overcome by providing the regulator with a mean instantaneous position value that is derived from measured position values collected at both bearings of the press roll.

The apparatus of present invention permits axial traversal of the material web to be created in the wound roll being produced, which solves a further problem that is discussed below.

Irregularities can occur in the thickness profile of the material web. These irregularities usually only occur briefly, especially in paper machines, because irregularities can be eliminated, e.g., by adjusting the headbox. However, small differences in thickness can adversely influence the winding structure. Thus, for example, it can happen that the winding diameter can be larger than the desired diameter at some point in the web width. This often leads to undesired local overstretching of the material web, which can have a significant effect on the flatness of printing papers, for example. Thus, the present invention provides a winding machine which, despite possible irregularities in the material web, guarantees a consistently trouble-free winding structure in as constant and reliable a manner as possible. For this purpose, the press roll (carrier drum) can be cyclically tilted relative to the travel direction of the supplied web, thereby creating an axial traversal of the material web. Thus, the press roll can be displaced or pivoted alternatingly in one direction and then in the other, so that the carrier drum and the wound roll being created on the reel spool are kept in contact with one another during the winding process, i.e., the winding nip is maintained. As a result of the cyclic tilting according to the invention, any irregularities that occur, such as an irregularly changing thickness cross-direction profile, can be distributed across a large region of the web width, so that flaws in the desired winding structure are practically eliminated and an at least approximately cylindrical winding diameter can be achieved despite any irregularities. Further, local overstretching of the material web can be prevented.

Accordingly, the present invention is directed to an apparatus for winding a material web into a wound roll on a winding core. The apparatus includes a press roll, movable press roll bearings coupled to the press roll, and a pressing device positioned to press the press roll against the wound roll. In this manner, the press roll and the wound roll form a winding nip, and the material web is guided around the press roll and through the winding nip. The pressing device is adapted to set a line load in the winding nip, and movable winding core bearings are couplable to the winding core of the wound roll and are adapted to move the winding core to compensate for an increasing wound roll diameter. The winding nip either remains in an at least approximately same position or is displaced by a small amount during winding. A driving device is positioned to move each of the movable winding core bearings, and a control device is arranged to control the driving device as a function of movement of the press roll from a desired position. A position measurement device, coupled to at least one of the movable press roll bearings, is adapted to produce an instantaneous position value of the press roll in accordance with a current position of the press roll, a regulator is adapted to compare the instantaneous position value with a desired position value of the press roll and to transmit an actuating variable that corresponds to a deviation of the instantaneous value from the desired value, and a wire is adapted to transmit the actuating variable from the regulator to the control device.

According to another feature of the present invention, the position measuring device can be coupled to each of the movable press roll bearings. The position measuring devices may be further coupled to an average value provider that transmits an average instantaneous position value derived from the two instantaneous position values to the regulator. Further, a desired value transmitter can be coupled to the regulator to provide the desired value. The desired value, while adjustable, may remain constant during a winding process. Alternatively, a desired value transmitter can be coupled to the regulator to provide the desired value, and the desired value may be variable during a winding process.

In accordance with another feature of the invention, each of the press roll bearings may be coupled to a position measuring device and to a position regulator. The driving device can include two driving devices and the control device can include two control devices, and the two driving devices may be respectively coupled to the two control devices, and the two control devices may each be coupled to receive the actuating variable output transmitted from the regulator. The regulator may include two regulators, and the apparatus can further include a desired value transmitter coupled to the desired value transmitter. The desired value transmitter may be adapted to transmit the same desired values to the two regulators. Alternatively, the desired value transmitter can be adapted to transmit a constant desired value to one of the two regulators and to transmit a cyclically variable desired value to the other of the two regulators. Further still, the desired value transmitter can be adapted to transmit to the two regulators desired values that cyclically vary opposite one another.

According to a further feature of the instant invention, the press roll can include a carrier drum, the winding core can include a reel spool, and the material web may be composed of one of paper and cardboard.

According to a still further feature of the invention, the small amount which the winding nip is displaced can be between approximately 10 and 200 mm.

The present invention also relates to a process for winding a material web that includes positioning a wound roll adjacent a carrier drum, and pressing the carrier drum against the wound roll with a pressing device, such that a winding nip is formed. The process also includes guiding the material web around the carrier drum and through the winding nip, moving the wound roll, in accordance with an increasing wound roll diameter, such that the winding nip one of remains in an at least approximately same position and is displaced by only a small amount. Further, the process includes measuring an instantaneous position of the carrier drum, comparing the measured instantaneous position of the carrier drum to a desired position of the press roll, transmitting an actuating signal which corresponds to a difference between the compared positions, and moving the wound roll in accordance with the actuating signal.

According to another feature of the instant invention, the measuring of the instantaneous position can include measuring an instantaneous position for each end of the carrier drum, and averaging the measured instantaneous positions-as the instantaneous position. Further, the desired position, while adjustable, may remain constant during winding. Alternatively, the desired position may be variable during winding.

In accordance with still another feature of the present invention, the measuring of the instantaneous position can include measuring an instantaneous position for each end of the carrier drum, the comparing can include independently comparing, in separate regulators, the respective instantaneous positions for the carrier drum ends to the desired position of the carrier drum, and the transmitting of the actuating signal may include independently transmitting actuating signals to separate devices for displacing the carrier drum. Moreover, the process can further include coupling a desired position transmitter to each of the separate regulators, and transmitting the desired position of the carrier drum to each of the separate regulators. The desired position transmitter can transmits a same signal to the separate regulators. Alternatively, the desired position transmitter may transmit a constant position signal to one of the separate regulators and may transmit a cyclically variable desired position signal to another of the separate regulators. Further, the desired position transmitter can transmit desired position signals to the separate regulators that cyclically vary with respect to each other.

According to a further feature of the invention, the process may farther include axially adjusting the position of the material web on the wound roll.

According to yet another feature of the instant invention, the process can further include pivoting the winding nip, such that the material web axially traverses the wound roll.

The present invention is also directed to an apparatus for winding a material web into a wound roll on a winding core. The apparatus can include a press roll, a pressing device being positioned to press the press roll against the wound roll, such that the press roll and the wound roll form a winding nip, and a moving device for moving the winding core of the wound roll to compensate for increasing wound roll diameter during winding. In this manner, the winding nip one of remains in an at least approximately same position or is displaced by a small amount during winding. A driving device can be positioned to move the moving device, and a control device can be arranged to control the driving device as a function of movement of the press roll from a desired position. A position measurement device is adapted to produce an instantaneous position value of the press roll in accordance with a current position of the press roll, a regulator is adapted to compare the instantaneous position value with a desired position value of the press roll and to transmit an actuating variable that corresponds to a deviation of the instantaneous value from the desired value, and the control device is coupled to receive the actuating variable from the regulator.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
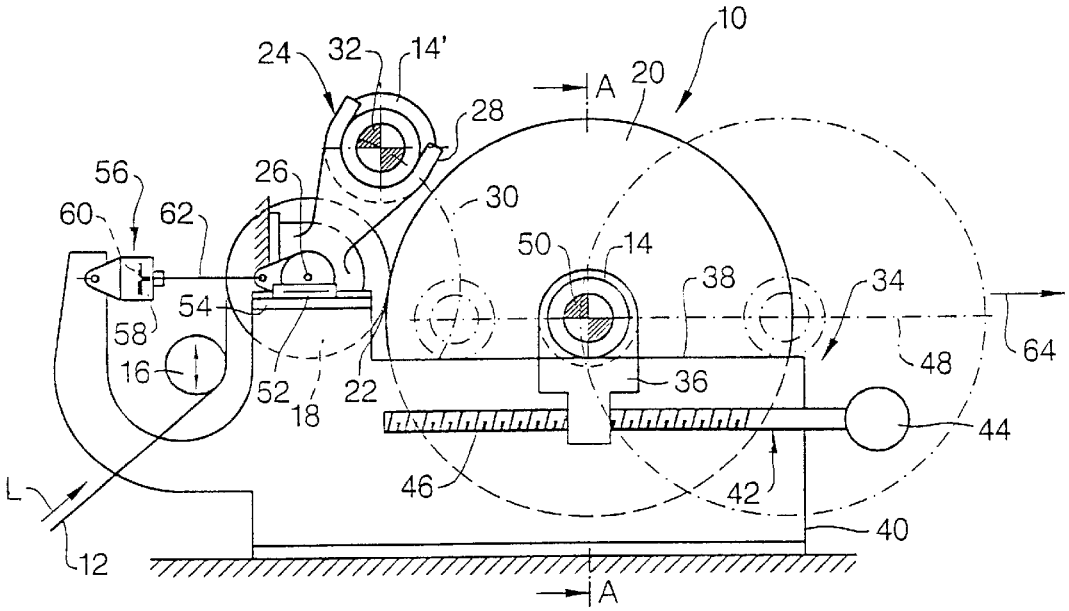
FIG. 1 illustrates a schematic side view of a winding machine in accordance with the present invention.

FIG. 1 schematically illustrates an exemplary embodiment of a winding machine 10 for winding a material web 12 onto a reel spool 14. Material web 12 can, e.g., be a paper or cardboard web. Winding machine 10 can, e.g., be provided at the end of a web production or processing machine.

Material web 12 is guided over a web guide roll 16, over a carrier drum (press roll) 18, and through a winding nip 22 formed between carrier drum 18 and either reel spool (winding core) 14 or wound roll 20 formed on reel spool 14. Carrier drum 18 and wound roll 20, which is being formed, are to be kept in contact with one another during the winding process to maintain winding nip 22.

In a primary bearing (holder) 24, a next and still-empty reel spool 14' is kept ready. In the exemplary embodiment, primary bearing 24 includes two levers 28 (only one of which is shown), which are pivotable around a fixed axis 26. Via levers 28, reel spool 14' can be moved or displaced along a first guide path 30, i.e., along a part of a circular path shown in dot-dashed lines. The midpoint of the circular path lies on axis 26. Reel spool 14' can be acted upon (driven) by a primary drive 32, to set reel spool 14' into rotation in primary bearing 24. Primary drive 32 can also be displaced along the first guide path 30.

Further, winding machine 10 includes a secondary bearing 34 which can have, e.g., a transport device 36 that can be displaced along a linear guide (not shown). Transport device 36 is provided to hold and to guide a given reel spool 14 and wound roll 20 formed thereon. Moreover, rails 38 can be provided, of which only one can be seen in FIG. 1. Rails 38 (of which only one is shown) are arranged parallel to the horizontal and are mounted on a machine frame 40. Thus, reel spool 14, which includes bearing pins, can be laid onto rails 38, such that the weight of reel spool 14 and/or wound roll 20 is accommodated by rails 38.

A driving device 42 is provided for driving wound roll 20 in a direction of arrow 64. Driving device 42 includes two threaded spindles 46, which act on both ends of reel spool 14 and each of which are driven by an associated electric motor 44 (see FIGS. 2 and 3).

In the exemplary embodiment, the forming wound roll 20 as well as reel spool 14 are moved along a second guide path 48, e.g., an essentially horizontal guide path, via transport device 36.

Reel spool 14 can be accelerated by a secondary drive 50, which is, e.g., a center drive and which can be displaced along second guide path 48.

Carrier drum 18, which can also be driven, e.g., by an articulated shaft 49 (shown in FIGS. 2 and 3), serves as a press roll that can be held, e.g., by a guide carriage 52 mounted for movement along a guide 54 that is arranged essentially parallel to rails 38 of secondary bearing 34. Associated with carrier drum 18 is a special pressing device 56 which is supported on machine frame 40 and which permits tilting of carrier drum 18 (see, also, FIG. 3).

Figure 2:
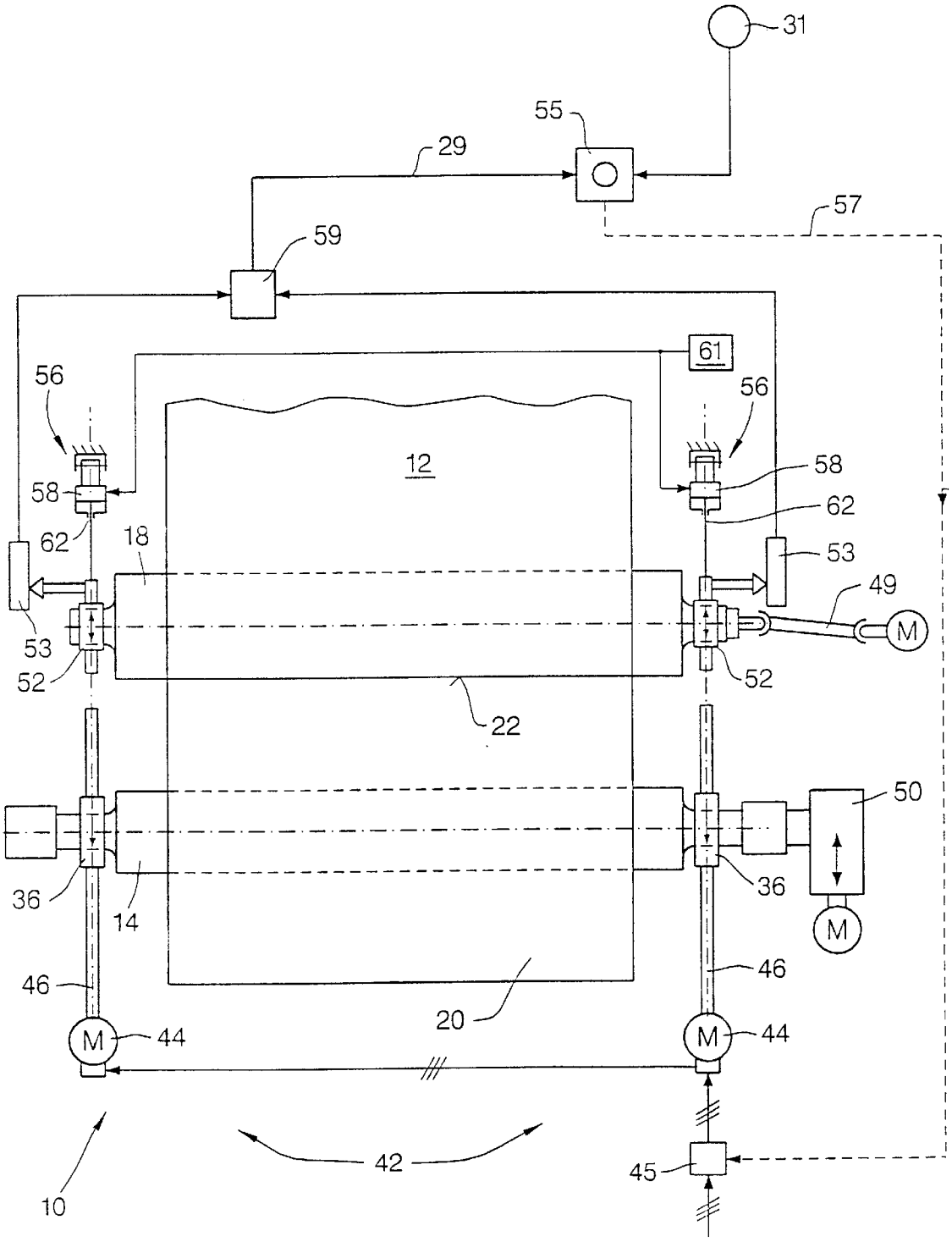
FIGS. 2 and 3 illustrate schematic top views of the winding machine depicted in FIG. 1 with different control arrangements.
Figure 3:
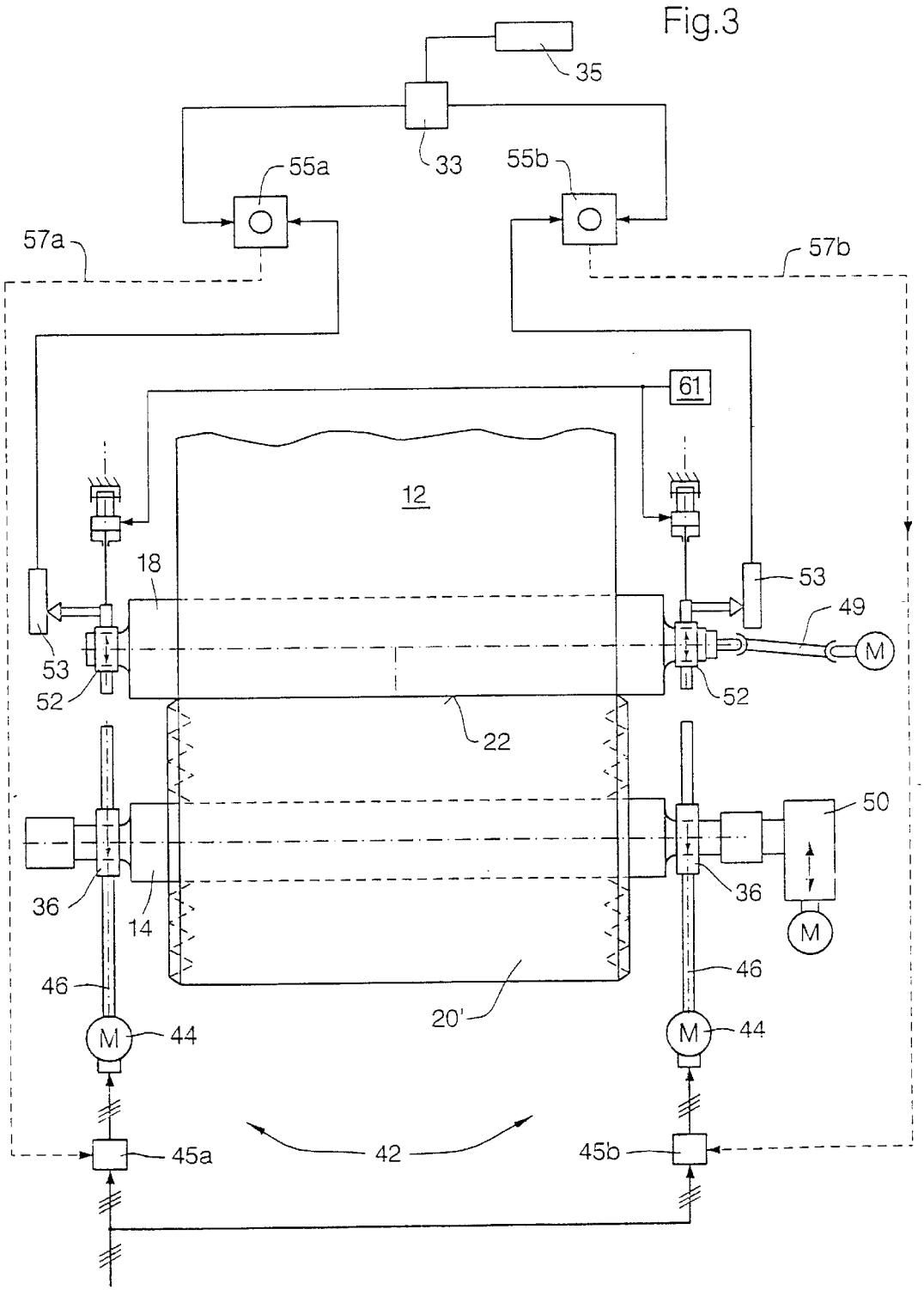

As can be seen, e.g., FIGS. 2 and 3, pressing device 56 can include two cylinder/piston units 58 that are arranged to grip both ends of carrier drum 18. Pistons 60 can each be connected to a piston rod 62 acting upon a respective end of carrier drum 18. When piston rod 62 is extended, guide carriage 52 and, therefore, carrier drum 18 are moved in the direction of the arrow 64 (i.e., to the right in FIG. 1). When piston rod 62 is retracted, carrier drum 18 is displaced in the opposite direction (i.e., to the left in FIG. 1).

During the winding phase or process depicted in FIG. 1, carrier drum 18 is pressed against reel spool 14 or wound roll 20 by a transport device 36 to form winding nip 22. Material web 12 is first guided in web travel direction L over web guide roll 16 and is deflected upwardly to be guided over carrier drum 18 with a belt wrap angle of about 180°.

The line load in winding nip 22 can be adjusted by pressing device 56, which is associated with carrier drum 18. Pressing device 56 can be part of a control circuit that independently adjusts the line load to a desired value and/or maintains the line load at a desired value. The pressure in cylinder/piston units 58 can also be adjusted by a control unit 61 as a function of the longitudinal stress of incoming material web 12 and/or dependent upon the increasing diameter of wound roll 20 and/or other parameters. As a result of the displacement of carrier drum 18 by pressing device 56, fluctuations in the line load can be reliably compensated or avoided so that the particular winding hardness desired can be continuously achieved. The increasing diameter of wound roll 20 may be compensated by a corresponding displacement of wound roll 20 in the direction of arrow 64.

In secondary bearing 34, drum 14 and, therefore, wound roll 20 can be guided in such a way that, if necessary, various tilted positions of wound roll 20 are allowed. This applies to the alternative embodiment depicted in FIG. 3, in which reel spool 14 is driven by associated driving device 42 so that wound roll 20 is cyclically tilted relative to travel direction L of material web 12 to cause axial traversal of material web 12. The axial traversal of web 12 is schematically depicted in FIG. 3 as serrated edges. Movements of carrier drum 18 are correspondingly followed by pressing device 56, whereby winding nip 22 is maintained and the line load in winding nip 22 is kept at a constant, individually specified value.

According to FIG. 1, the next and still-empty reel spool 14' can be placed diagonally above carrier drum 18 in primary bearing 24. Through the pivoting of levers 28, reel spool 14' can be subsequently moved along first guide path 30 from an initial winding position to a transfer position, as shown in FIG. 1 by the dot-dashed lines on the lower end of guide path 30. Starting from the transfer position, wound roll 20, as it is being formed on reel spool 14, can be moved or transferred along second guide path 48 to a final winding position depicted in continuous lines. Subsequently, wound roll 20 can be transferred to a removal position, which is depicted in dot-dashed lines, from which the finished wound roll 20 can be removed, e.g., by a crane.

It is common to all exemplary embodiments that the position of the press roll (carrier drum) 18 is determined by an instantaneous or current diameter and, at the same time, by the instantaneous or current position of wound roll 20. This is because press roll 18 is being constantly pressed against wound roll 20 via pressing device 56, 58, 60, 61, and 62. During the winding process, it is preferable that the position of press roll 18 either to change very little, e.g., between approximately ±5 to 50 mm about a center position, or to be displaced by a small amount, e.g., between approximately 10 to 200 mm from an initial position to a final position.

For this purpose, a position regulator 55 is provided to compare an instantaneous position value, input through a wire 29, with a desired position value, e.g., from a desired position transmitter 31, and to provide an actuating variable on wire 57 that corresponds to a deviation of the instantaneous value from the desired value. The actuating variable can be transmitted to control device 45 of driving device 42, 44, and 46 for displacing reel spool bearing 36. The arrangement is such that reel spool bearing 36 can be displaced in accordance with the actuating variable either in steps or continuously so that pressing roll 18 assumes or approaches the desired position. If necessary, a pilot control (not shown) can be provided for the driving device 42, 44, and 46. This would ensure that motors 44 intermittently run at a speed determined by the working speed of winding machine 10 and/or the increase in diameter of wound roll 20 per unit of time.

According to FIG. 2, a mean instantaneous position value can be determined by an average value provider 59 from two instantaneous position values collected at bearings 52 of carrier drum 18 with the aid of position measuring devices 53. A single control device 45 is provided at driving device 42, which directly controls one of two motors 44 and indirectly controls the second motor through the first motor.

According to FIG. 3, each side has its own position regulator **55*a* and 55*b* and its own control device 45*a* and 45*b*. A desired position transmitter 33, controlled by a traversing programmer 35, can provide cyclically variable desired values to regulators 55*a* and 55*b***.

In this manner, press roll 18 and wound roll 20' may be alternatingly tilted in both directions with respect to one another for short periods. In this regard, axial traversal can be achieved in wound roll 20', which is increasing in size. The axial traversing is schematically depicted in FIG. 3 with zig-zag lines along the edges of wound roll 20'.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. An apparatus for winding a material web into a wound roll on a winding core, the apparatus comprising:

a press roll;

movable press roll bearings coupled to said press roll;

a pressing device being positioned to press said press roll against the wound roll, whereby said press roll and the wound roll form a winding nip, and wherein the material web is guided around said press roll and through said winding nip;

said pressing device being adapted to set a line load in said winding nip;

movable winding core bearings couplable to the winding core of the wound roll and being adapted to move the winding core to compensate for an increasing wound roll diameter, wherein said winding nip one of remains in an at least approximately same position or is displaced by a small amount during winding;

a driving device being positioned to move each of said movable winding core bearings;

a control device arranged to control said driving device as a function of movement of said press roll from a desired position;

a position measurement device, coupled to at least one of said movable press roll bearings, which is adapted to produce an instantaneous position value of said press roll in accordance with a current position of said press roll;

a regulator being adapted to compare the instantaneous position value with a desired position value of said press roll and to transmit an actuating variable that corresponds to a deviation of the instantaneous value from the desired value; and a wire being adapted to transmit the actuating variable from said regulator to said control device.

2. The apparatus in accordance with claim 1, wherein said position measurement device is coupled to each of the movable press roll bearings, and wherein said position measurement devices are further coupled to an average value provider that transmits an average instantaneous position value derived from the instantaneous position values of each of the movable press roll bearings to said regulator.

3. The apparatus in accordance with claim 2, further comprising a desired value transmitter coupled to said regulator to provide the desired value, wherein the desired value, while adjustable, remains constant during a winding process.

4. The apparatus in accordance with claim 2, further comprising a desired value transmitter coupled to said regulator to provide the desired value, wherein the desired value is variable during a winding process.

5. The apparatus in accordance with claim 1, wherein each of said press roll bearings is coupled to said position measuring device and to said regulator, wherein said driving device comprises two driving devices and said control device comprises two control devices, and wherein said two driving devices are respectively coupled to said two control devices, and said two control devices are each coupled to receive the actuating variable transmitted from said regulator.

6. The apparatus in accordance with claim 5, wherein said regulator comprises two position regulating devices, and said apparatus further comprises a desired value transmitter coupled to said two position regulating devices.

7. The apparatus in accordance with claim 6, said desired value transmitter being adapted to transmit the same desired values to said two position regulating devices.

8. The apparatus in accordance with claim 6, said desired value transmitter being adapted to transmit a constant desired value to one of said two position regulating devices and to transmit a cyclically variable desired value to the other of said two position regulating devices.

9. The apparatus in accordance with claim 6, said desired value transmitter is adapted to transmit to said two position regulating devices desired values that cyclically vary opposite one another.

10. The apparatus in accordance with claim 1, wherein said press roll comprises a carrier drum, the winding core comprises a reel spool, and the material web is composed of one of paper and cardboard.

11. The apparatus in accordance with claim 1, wherein the small amount which the winding nip is displaced is between approximately 10 and 200 mm.

12. A process for winding a material web comprising:

positioning a wound roll adjacent a carrier drum;

pressing the carrier drum against the wound roll with a pressing device, whereby a winding nip is formed;

guiding the material web around the carrier drum and through the winding nip;

moving the wound roll, in accordance with an increasing wound roll diameter, such that the winding nip one of remains in an at least approximately same position and is displaced by only a small amount;

measuring an instantaneous position of the carrier drum;

comparing the measured instantaneous position of the carrier drum to a desired position of the carrier drum;

transmitting an actuating signal which corresponds to a difference between the compared positions; and moving the wound roll in accordance with the actuating signal.

13. The process in accordance with claim 12, wherein said measuring of the instantaneous position comprises:

measuring an instantaneous position for each end of the carrier drum; and averaging the measured instantaneous positions as the instantaneous position.

14. The process in accordance with claim 13, wherein the desired position, while adjustable, remains constant during winding.

15. The process in accordance with claim 13, wherein the desired position is variable during winding.

16. The process in accordance with claim 12, wherein said measuring of the instantaneous position comprises measuring an instantaneous position for each end of the carrier drum, wherein said comparing comprises independently comparing, in separate regulators, the respective instantaneous positions for the carrier drum ends to the desired position of the carrier drum, and wherein said transmitting of the actuating signal comprises independently transmitting actuating signals to separate devices for displacing the carrier drum.

17. The process in accordance with claim 16, further comprising:

coupling a desired position transmitter to each of the separate regulators; and transmitting the desired position of the carrier drum to each of the separate regulators.

18. The process in accordance with claim 17, wherein said desired position transmitter transmits a same signal to the separate regulators.

19. The process in accordance with claim 17, wherein said desired position transmitter transmits a constant position signal to one of the separate regulators and transmits a cyclically variable desired position signal to another of the separate regulators.

20. The process in accordance with claim 17, wherein said desired position transmitter transmits desired position signals to the separate regulators that cyclically vary with respect to each other.

21. The process in accordance with claim 12, further comprising axially adjusting the position of the material web on the wound roll.

22. The process in accordance with claim 12, further comprising pivoting the winding nip, whereby the material web axially traverses the wound roll.

23. An apparatus for winding a material web into a wound roll on a winding core, the apparatus comprising:

a press roll;

a pressing device being positioned to press said press roll against the wound roll, whereby said press roll and the wound roll form a winding nip;

a moving device for moving the winding core of the wound roll to compensate for increasing wound roll diameter during winding, whereby said winding nip one of remains in at least approximately the same position and is displaced by a small amount during winding;

a driving device being positioned to move said moving device;

a control device arranged to control said driving device as a function of movement of said press roll from a desired position;

a position measurement device being adapted to produce an instantaneous position value of said press roll in accordance with a current position of said press roll;

a regulator being adapted to compare the instantaneous position value with a desired position value of said press roll and to transmit an actuating variable that corresponds to a deviation of the instantaneous value from the desired value; and said control device being coupled to receive the actuating variable from said regulator.

* * * * *